US009073093B2

(12) United States Patent
Endou et al.

(10) Patent No.: US 9,073,093 B2
(45) Date of Patent: Jul. 7, 2015

(54) LABEL SEPARATING APPARATUS

(71) Applicants: Yasuyuki Endou, Tokyo (JP); Masaki Tamura, Tokyo (JP); Masahiro Naka, Narashino (JP); Toshiyuki Yamagata, Narashino (JP); Hiroyuki Shibata, Narashino (JP)

(72) Inventors: Yasuyuki Endou, Tokyo (JP); Masaki Tamura, Tokyo (JP); Masahiro Naka, Narashino (JP); Toshiyuki Yamagata, Narashino (JP); Hiroyuki Shibata, Narashino (JP)

(73) Assignee: MIYAKOSHI PRINTING MACHINERY CO., LTD., Narashino-shi, Chiba (JP)

( * ) Notice: Subject to any disclaimer, the term of this patent is extended or adjusted under 35 U.S.C. 154(b) by 0 days.

(21) Appl. No.: 14/259,927

(22) Filed: Apr. 23, 2014

(65) Prior Publication Data

US 2014/0319028 A1 Oct. 30, 2014

(30) Foreign Application Priority Data

Apr. 26, 2013 (JP) ..... 2013-093396

(51) Int. Cl.

| | |
|---|---|
| ***B07C 5/36*** | (2006.01) |
| ***B65C 9/18*** | (2006.01) |
| ***B65C 9/40*** | (2006.01) |

(52) U.S. Cl.

CPC ..... *B07C 5/368* (2013.01); *B65C 9/1865* (2013.01); *B65C 9/40* (2013.01); *B65C 2009/404* (2013.01)

(58) Field of Classification Search

CPC ..... B07C 5/342; B07C 5/3422; B07C 5/363; B07C 5/368; B07C 5/367; B65C 9/1865; B65C 2009/404; B07B 9/02; B65H 2404/1311; B65H 2404/1316; B65H 2404/13161; B65H 2404/132; B65H 2404/1321

See application file for complete search history.

(56) References Cited

U.S. PATENT DOCUMENTS

| | | | |
|---|---|---|---|
| RE30,419 | E | 10/1980 | Crankshaw et al. |
| 2007/0114109 | A1 | 5/2007 | Berndtsson et al. |
| 2012/0211173 | A1 | 8/2012 | Fefin |

FOREIGN PATENT DOCUMENTS

| | | | |
|---|---|---|---|
| EP | 1787913 | A1 | 5/2007 |
| JP | 2011-148556 | A | 8/2011 |
| JP | 2011-195151 | A | 10/2011 |
| WO | 2011051396 | A1 | 5/2011 |

OTHER PUBLICATIONS

European Search Report dated Jun. 13, 2014 in counterpart European Application No. 14165567.0.

*Primary Examiner* — Michael McCullough

(74) *Attorney, Agent, or Firm* — Holtz, Holtz, Goodman & Chick PC

(57) ABSTRACT

The invention relates to a label separating apparatus in which, of labels formed in rows and columns on a continuous substrate being transported along a line of transport, labels found good and labels found defective upon determination of their quality are transported separately. The invention seeks to ensure that all of a plurality of defective labels possibly extant in any one of the rows can concurrently be transferred without fail selectively onto a different line of transport.

The apparatus includes a primary conveyer in which a continuous substrate 21A is transported having labels 22A-22D, which are spaced apart from each other by a given distance and arranged in rows and columns, formed thereon and peelably adhered thereto. The primary conveyer includes a transport turn-back member 12A for permitting labels 22A-22D for each row concurrently to peel off the continuous substrate 21. In the apparatus, a label peeled off by the transport turn-back member 12A and found defective is subjected to an air blast by an air-blasting member 15A, 15B, 15C, 15D and is thereby oriented in transport towards a conveyer for defective labels 14 and adhered to on the conveyer for defective labels 14 while it is held by a label holding member 16 formed with an air draining vent 16C.

1 Claim, 6 Drawing Sheets

LABEL SEPARATING APPARATUS

TECHNICAL FIELD

The present invention relates to a label separating apparatus for separately transporting good labels and defective labels out of labels formed in a plurality of lines, i.e. in rows and columns, on a continuous substrate in transport.

BACKGROUND ART

In recent years, in attaching labels to products in large volume, it has been practiced to form labels in rows and columns on a continuous supporting sheet and to successively attach good labels selectively to products. And, to make sure that labels formed on the continuous supporting sheet are all good, all the labels are individually inspected to separate labels then found defective from labels then ascertained good. It is essential in this case to ensure in separation that defective labels are not mixed in good labels.

In production of labels, techniques of separating defective labels have so far been proposed as in the patent literature cited infra. JP 2011-195151 A discloses a system for a single line of labels which are successively spaced apart from each other by a given distance and adhered to a supporting substrate sheet, the system being provided with a primary line of transport of labels and a line of transport of defective labels. Labels are successively inspected on the primary line of label transport for determination of their quality and a label found defective is peeled off while it is pressed with a pressing member against a pressure receiving member, and is then adhered on a collecting substrate sheet on the line of transport for defective labels.

Also, in JP 2011-148556 A, labels are described which are arranged in a single line on successive elongate label substrates. In continuous transport of the successive elongate label substrates, one label substrate is connected to a next label substrate with a joint label as a particular label to which air is blasted selectively for peeling and removal for label separation.

It is possible, apropos, to substitute labels in a single line on the supporting substrate sheet described in JP 2011-195151 A with those arranged in rows and columns and to substitute the pressing member described therein with an air-blasting mechanism as shown in JP 2011-148556 A for every column such that a blast of air can be applied to a defective label in each row of labels so that the defective label can thereby be forced against the pressure receiving member corresponding to labels in plural columns and adhered onto the collecting substrate sheet on a line of transport for defective labels.

If, however, a plurality of defective labels exist for each row, it has now been found that forcing such defective labels against the pressure receiving member with air of blasts gives rise to a problem that a space between these labels and the pressure receiving member tends to be and to continue to be filled with air of the blasts passing through therearound, finding no way of escape, which prevents separation of defective labels which are to be separated by blasts of air and to be originally separated thereby. Especially, a defective label of three defective labels on adjacent three columns in a row tends to be affected by such a stay of air with the result that the defective label fails to be adhered onto a collecting substrate sheet in a line of transport for defective labels.

Made in view of such problems met in the art, the present invention has for its object to provide a label separating apparatus which ensures that all of a plurality of defective labels possibly extant in any one of the rows can concurrently be transferred without fail discriminatorily onto a different line of transport.

SUMMARY OF THE INVENTION

In order to achieve the object mentioned above, there is provided in accordance with the present invention a label separating apparatus for separating labels which are spaced apart from each other by a given distance and arranged in rows and columns on and peelably adhered to a first continuous substrate in transport, upon determining quality of labels, by transporting defective labels separately from a group of good labels, which apparatus comprises: a primary conveyer for transporting the first continuous substrate having labels adhered thereto in rows and columns, the primary conveyer including a transport turn-back member for causing labels in each of the rows concurrently to peel off the first continuous substrate; disposed in the vicinity of the transport turn-back member of the primary conveyer, a conveyer for defective labels for receiving defective labels selectively as adhered to thereon and transporting the defective labels thereby discriminatorily; disposed in a region between the transport turn-back member of the primary conveyer and the conveyer for defective labels, a given number of air-blasting members each adapted to apply a blast of air to a label in each of the columns so that a label peeled off the continuous substrate and found defective is oriented in transport towards the conveyer for defective labels; and a label holding means for holding such a defective label oriented in transport by air from the air-blasting member to guide the defective label onto the conveyer for defective labels, the label holding member being formed with an air draining vent in a surface including its label holding area.

According to the present invention, the label separating apparatus includes a primary conveyer in which a continuous substrate is transported having labels, which are spaced apart from each other by a given distance and arranged in rows and columns, formed thereon and peelably adhered thereto. The primary conveyer includes a transport turn-back member for permitting labels for each row concurrently to peel off the continuous substrate. In the apparatus, a label peeled off by the transport turn-back member and found defective is subjected to a blast of air by an air-blasting member and is thereby oriented in transport towards a conveyer for defective labels and adhered to on the conveyer for defective labels while it is held by a label holding member formed with an air draining vent, the vent ensuring that air is prevented from entering and staying between the label holding member and a defective label so that labels if they happen to be in succession for any single row can, all together without fail, be allowed selectively to adhere to on and to be transported by the conveyer for defective labels.

BEST MODES FOR CARRYING OUT THE INVENTION

Figure 1A:
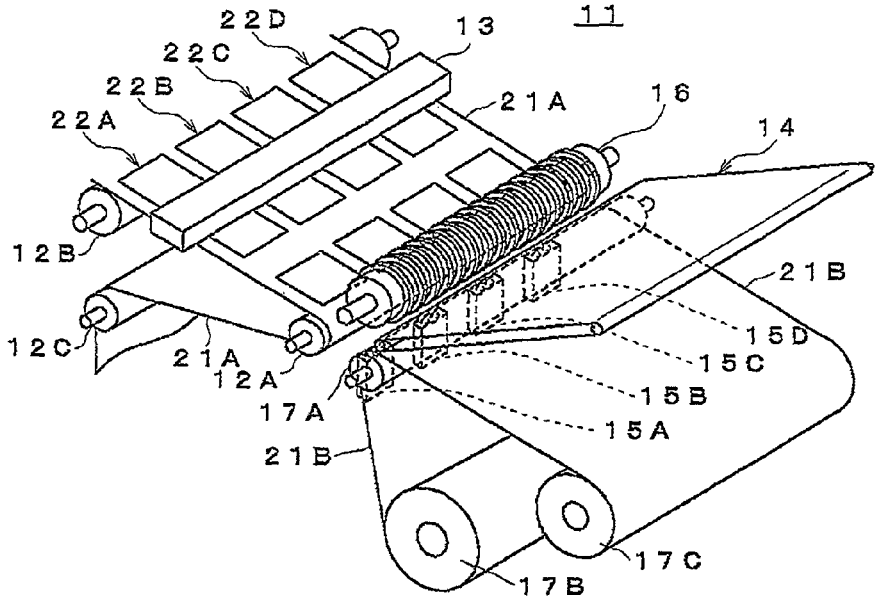
FIGS. 1A to 1C are views illustrating the makeup of a label separating apparatus according to the present invention.

Explanation is given below of forms of implementation of the present invention with reference to the Drawing Figures. While the forms of implementation may be described as applied to labels printed with a given piece of information, the present invention is applicable to labels as well which are provided with a communication function such as RFID.

Figure 1B:
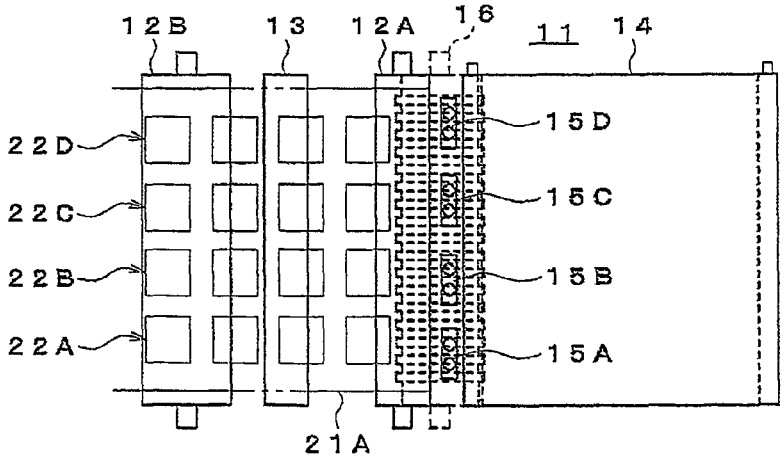
Figure 1C:
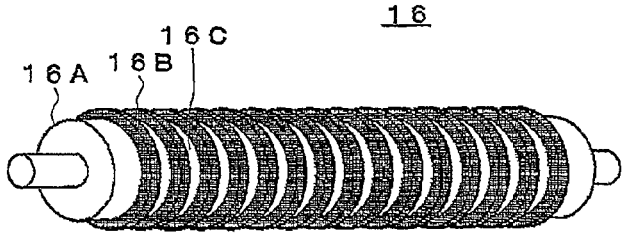
Figure 2A:
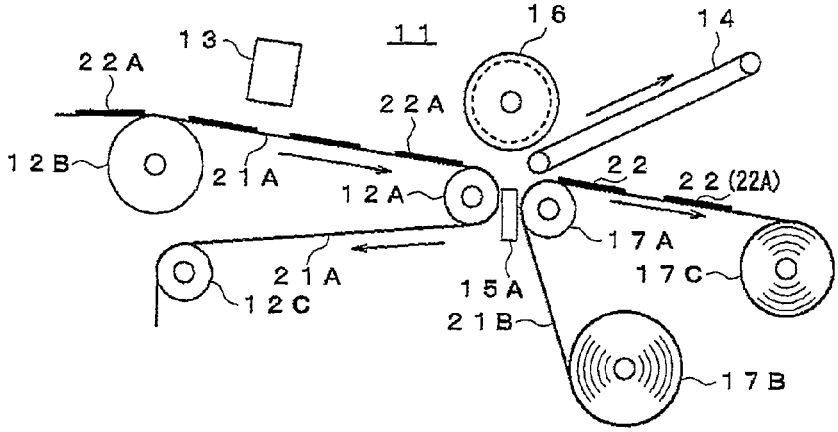
FIGS. 2A to 2C are explanatory views which illustrate labels being transported in the label separating apparatus shown in FIGS. 1A to 1C.

FIGS. 1A to 1C show diagrammatically the makeup of a label separating apparatus according to the present invention. FIG. 2A is a side conceptual view of the apparatus made up as shown in FIGS. 1A and 1B. Referring to FIGS. 1A and 1B, the label separating apparatus, designated by reference character 11, includes a primary conveyer made up comprising conveyer rollers 12A, 12B and 12C. To transport a continuous sheet along a line of transport from its supply part to its take-up part in the primary conveyer, a conventional mechanism may be applied whose detailed description is omitted. The conveyer roller 12A here constitutes a transport turn-back member that deflects a first continuous substrate 21A along a line of transport towards the conveyer roller 12C and where labels 22A to 22D for each row are allowed to concurrently peel off the first continuous substrate 21A (as will be described in connection with FIGS. 2A to 2C).

It should be noted here that the first continuous substrate 21A transported by the primary conveyer may be a continuous supporting sheet having a release agent applied on its label adherent surface onto which labels having an adhesive agent applied to their adhesive faces are peelably attached and adhered at a given spacing distance with these faces in contact with that surface of the first continuous substrate 21A. Such labels are arranged in rows and in a plurality of, here four columns, viz. labels 22A, 22B, 22C and 22D as shown. The first continuous substrate 21A having labels 22A to 22D adhered thereto is of a conventional form.

Above the first continuous substrate 21A being transported at a position in the path of its transport of the primary conveyer to the conveyer roller 12A, there is provided a label recognition unit 13 for recognizing labels 22A to 22D in each of the rows on the continuous substrate 21A. The label recognition unit 13 provides a discrimination unit not shown (a discriminant processing system as part of a control system for the entire apparatus) with data of recognition of a target label to determine its quality, i.e. if it is good or defective.

Here, a print face of label may be imaged to determine if it is printed good or defectively. If the label is judged or found defective, a timing signal is generated for control of operation of an air-blasting member for the label as described later. Note that if the label is, for example, a RFID label, the label recognition unit 13 is to act as a reader-writer for communication with the RFID label to determine quality of the label on the basis of the state of communication.

In the neighborhood of the conveyer roller 12A that constitutes the transport turn-back member in the primary conveyer, there is disposed a conveyer for defective labels 14 having a line of transport that is different from that in the primary conveyer and on which a label found defective is adhered to and transported separately or discriminatorily. The conveyer for defective labels 14 has a form of belt conveyer and is disposed at a distance from the conveyer roller 12A that is shorter at least than a length of a label (in the direction of its transport). Note that one to which a defective label is adhered may be any suitable member and may, for example, have a form suitable to transport a continuous sheet of paper.

Spaced by a given distance from the conveyer roller 12A that constitutes the transport turn-back member in the primary conveyer, a conveyer for good labels is provided therein as a line of transport positioned in line with an extension of the line of transport in the primary conveyer. The conveyer for good labels includes a conveyer roller 17A that stands opposite to the conveyer roller 12A and which, together with a supply part 17B and a take-up part 17C for a second continuous substrate 21B, provides the line of transport for the second continuous substrate 21B, e.g. as a continuous supporting sheet. Labels found good are selectively adhered onto the second continuous substrate 21B. Note further that the conveyer rollers 17A and 12A are spaced from each other by a distance which, while air-blast members 15A to 15D as described later are positioned between them, is shorter at least than a length of a label 22A, 22B, 22C, 22D.

Between the conveyer roller 12A (i.e. the transport turn-back member) in the primary conveyer and the conveyer for defective labels 14 and, in other words, between the conveyer roller 12A and the conveyer roller 17A and under them as shown in FIG. 1A and below-mentioned FIG. 2C, there are provided four air-blasting members 15A, 15B, 15C and 15D corresponding to four columns for the labels 22A, 22B, 22C and 22D on the first continuous sheet 21A, respectively. An air-blast members 15A, 15B, 15C, 15D is operated to apply an blast of air to a label allowed by the conveyer roller 12A acting as the transport turn-back member to peel off and found defective by the label recognition unit 13 to orient the defective label towards the conveyer for defective labels 14.

Blasting of air by the air-blasting member 15A, 15B, 15C, 15D against a defective label is preferably directed towards a central area or two side areas (in a direction perpendicular to the said length) of the label. While the air-blasting members 15A to 15D are shown only of their nozzle parts, it should be noted that blasting of air by each of them is controlled by its air supply and air supply control system (air supply control system as part of a control system for the entire apparatus) not shown.

Above the air-blasting members 15A to 15D, a label holding member 16 is positioned corresponding to all over the columns of labels 22A to 22D in the row direction on the first continuous substrate 21A. While the label holding member 16 is shown in the form of a roller, it may or may not be rotated. For example, it may be rotated to ensure that a defective label is moved. The label holding member 16 is provided to hold a defective label oriented by the air-blasting member 15A, 15B, 15C, 15D and to guide it onto the conveyer for defective labels 14.

Further, the label holding member 16 as shown in FIG. 1C is formed on its peripheral surface with recesses and projections. For example, it may have a base cylinder 16A and rings fitted thereon to form such projections 16B and recesses 16C. To with, then a projection 16B acts to hold a defective label peeled off by blasting of air whereas a recess 16C forming a groove serves to cause air from an air-blasting member 15A, 15B, 15C, 15D to be drained and vented through the groove and not to enter and stay between the label and the label holding member 16 while forcing the label against the label holding member 16. The recess 16C thus constitutes an air draining vent formed in a surface including a label holding part of the member 16.

Figure 2B:
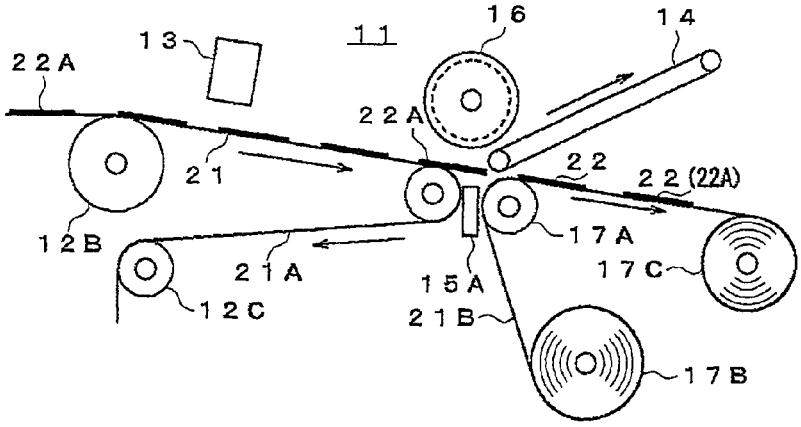
Figure 2C:
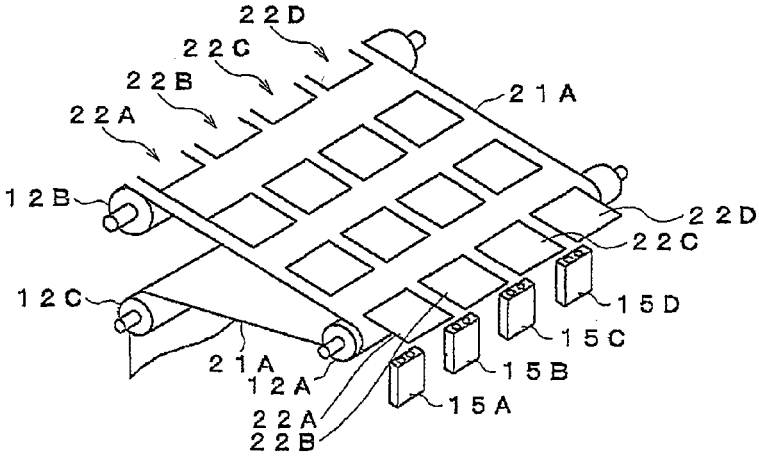

Here, FIGS. 2A to 2C is referred to, in which labels in the label separating apparatus shown in FIGS. 1A to 1C are illustrated as they are being transported. As shown in FIG. 2A, the first continuous substrate 21A having labels 22A to 22D adhered thereto is transported along a line of transport from the conveyer roller 12B to the conveyer roller 12A acting as the transport turn-back member where it is turned back to travel towards the conveyer roller 12C along the line of transport. Then, as shown in FIGS. 2B and 2C all the labels 22A to 22D having reached a position of the conveyer roller 12A acting as the transport turn-back member are respectively allowed to leave or peel off the first continuous substrate 21A gradually according to an angle of turn-back and a tension of transport. To allow a label to peel off, note that according to a force of its adhesion, an angle of turn-back is suitably set. For example, a size is set in diameter of the conveyer roller 12A. Note also that it is possible not to use a roller but to use a projecting plate member where labels in each row are allowed to peel off according to an angle of its contact with the first continuous substrate 21A.

And, a label found good is passed in the absence of air-blasting from the member 15A, 15B, 15C, 15D and adhered onto the second continuous substrate 21B in continuous transport in the conveyer for good labels (comprising the conveyer roller 17A, the second continuous substrate supply part 17B and the second continuous substrate take-up part 17C) forming a line of transport positioned in line with an extension of that in the primary conveyer. Good labels are adhered here in an arrangement identical to that in which labels 22A to 22D are adhered on the first continuous substrate 21A and in the arrangement in which defective labels are omitted.

Figure 3A:
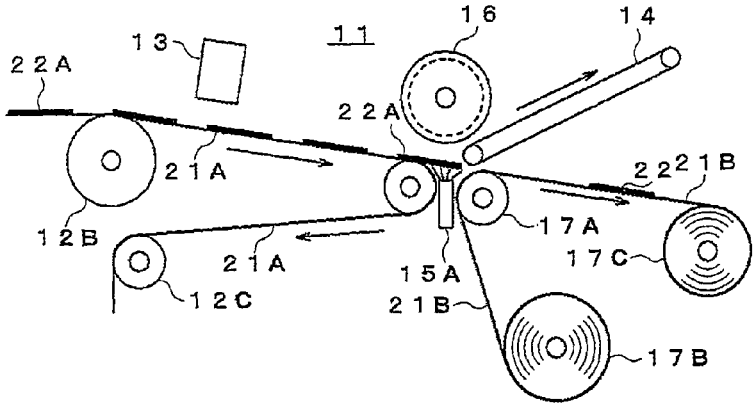
FIGS. 3A to 3C are explanatory views of operation (1) in label separation by the label separating apparatus of the invention.

FIGS. 3A to 3C and FIGS. 4A and 4B are now referred to, which illustrate modes of operation of label separation in the label separating apparatus of the present invention. Here, mention is made of where labels 22A, 22B and 23C which are side by side in a row on the first continuous substrate 21A are found to be defective labels 22X. Referring to FIG. 3A, these labels found to be defective labels 22X (22A), 22X (22B) and 22X (22C) are allowed by the conveyer roller 12A acting as the transport turn-back member to be peeling off gradually. The defective labels 22X (22A), 22X (22B) and 22X (22C) are then subjected to blasts of air from the air-blasting members 15A, 15B and 15C.

Figure 3B:
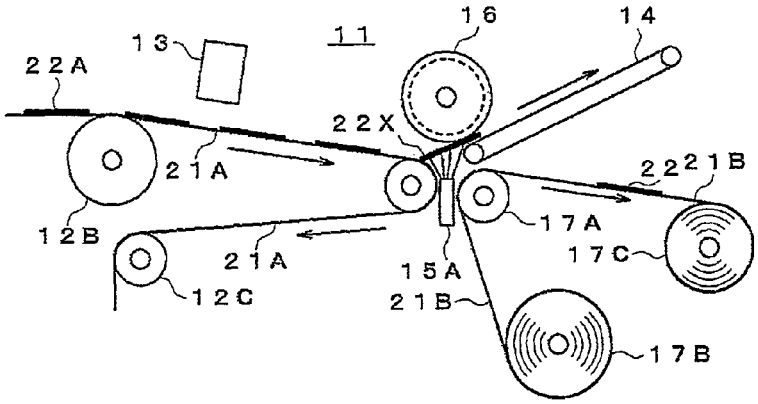
Figure 3C:
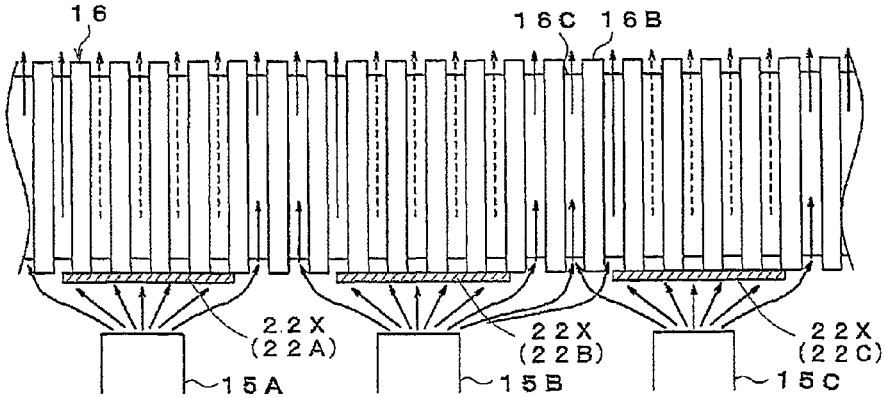

As shown in FIG. 3B the defective labels 22X (22A), 22X (22B) and 22X (22C) subjected to blasts of air are thereby oriented in transport and transferred by air towards the conveyer for defective labels 14 while they are being held by the label holding member 16 (projections 16B), and moved by a force of transport by the primary conveyer towards the conveyer for defective labels 14. As shown in FIG. 3C, air from the air-blasting members 15A, 15B and 15C and around the defective labels 22X (22A), 22X (22B) and 22X (22C) is vented through the recesses 16C in the label holding member 16, thus escaping therethrough without entering and staying between the label holding member 16 and a label found defective. Consequently, a defective label positioned, e.g. intermediate, 22X (22B), is forced enough against the label holding member 16 by air from the air-blasting member 15B while it is being peeled off the first continuous substrate 21A to move towards the conveyer for defective labels 14.

Figure 4A:
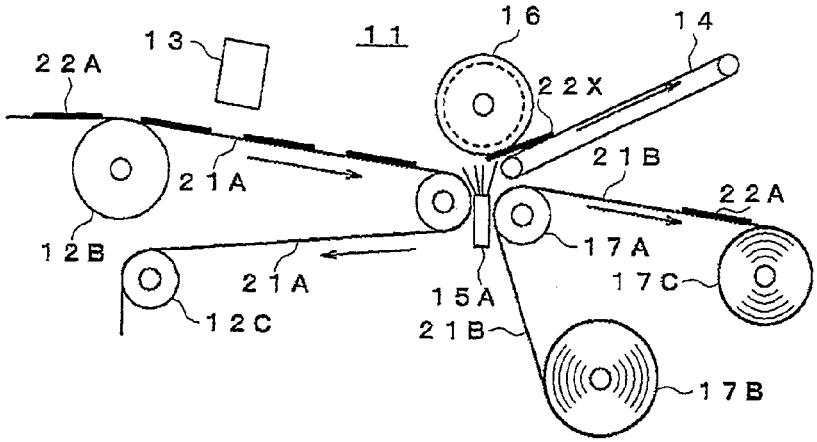
FIGS. 4A and 4B are explanatory views of operation (2) in label separation by the label separating apparatus of the invention.
Figure 4B:
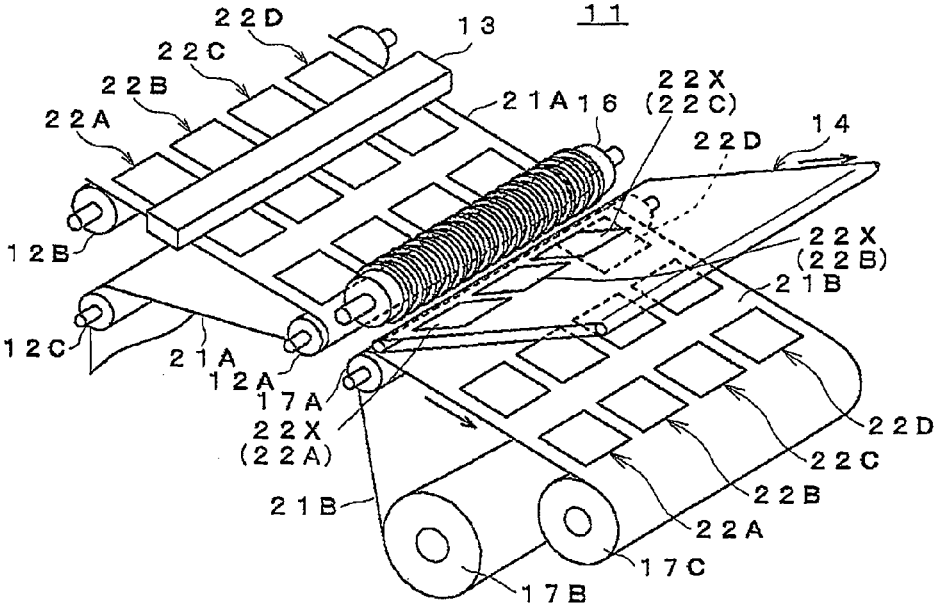

And, as shown in FIGS. 4A and 4B the defective labels 22X (22A), 22X (22B) and 22X (22C) while they are being forced against the holding member 16 by the blasts of air from the air-blasting members 15A, 15B and 15C are forwarded onto the conveyer for defective labels 14 by a force of transport by the primary conveyer, and are adhered to on and transported by the conveyer for defective labels 14, discriminatorily or separately of the label 22D found good. Meanwhile, the good label 22D while it is being peeled off the first continuous substrate 21A by the conveyer roller 12A acting as the transport turn-back member is passed in the absence of air-blasting from the air-blasting member 15D and is adhered to the second continuous substrate 21B on the conveyer for good labels.

Figure 5A:
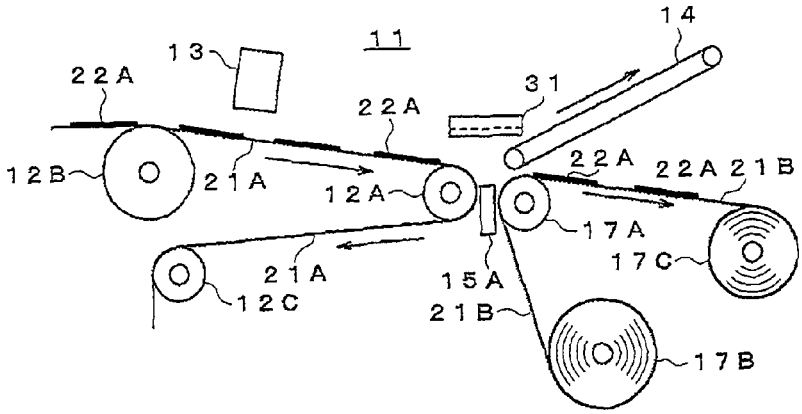
FIGS. 5A and 5B are explanatory views illustrating a label holding means implemented in another form in the label separating apparatus of the invention.
Figure 5B:
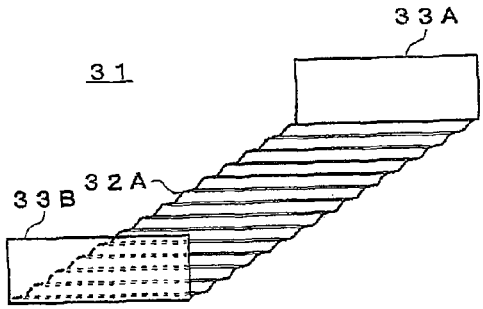
Figure 6A:
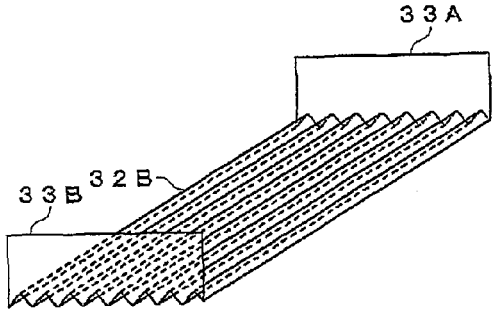
FIGS. 6A and 6B are explanatory views illustrating modified forms of implementation of the label holding means shown in FIGS. 5A and 5B.
Figure 6B:
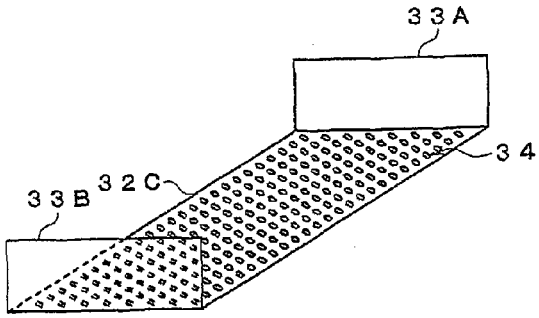

Reference is now made to FIGS. 5A and 5B which illustrate another form of implementation of the label holding member in a label separating apparatus of the present invention and to FIGS. 6A and 6B each of which illustrates a modified form of implementation of the label holding member shown in FIGS. 5A and 5B. The label separating apparatus shown in FIGS. 5A and 5B substitutes the cylindrical label holding member 16 in the previous form of implementation with a label holding member 31 having a holding surface in the form of a plate.

To with, the label holding member 31 as shown in FIG. 5B is formed with a label holding plate 32A positioned and sized in its length to cover an entire axial length of the conveyer roller 12A and a pair of its side plates 33A and 33B, e.g. for mounting the member. The label holding plate 32A is corrugated in a direction parallel to an axis of the conveyer roller 12A, thereby forming projections for holding a defective label 22X and recesses for serving as an air draining vent means.

FIG. 6A shows a label holding member 31 which is like that shown in FIG. 5B and whose plate 32A is corrugated in a direction parallel to the line of transport of the first continuous substrate 21A. In this form of implementation as well, there are formed projections for holding a defective label and recesses for air venting. FIG. 6B shows a label holding member 31 which has a planar label holding plate 32C formed with a given number of air venting holes 34 that correspond to the recesses whereby an air stay can be prevented.

Thus, the air draining and venting means formed in the label holding member 16, 31 (recesses 16C, recesses in 32A; recesses in 32B; air venting holes 34) acts to prevent air from entering and staying between the label holding member 16, 31 and the defective label 22X whereby defective labels 22X if they happen to be in succession in any single row can, all together without fail, be adhered to on and transported by the conveyer for defective labels 14 discriminatorily. This applies essentially to a form of implementation shown in FIGS. 7A and 7B.

Figure 7A:
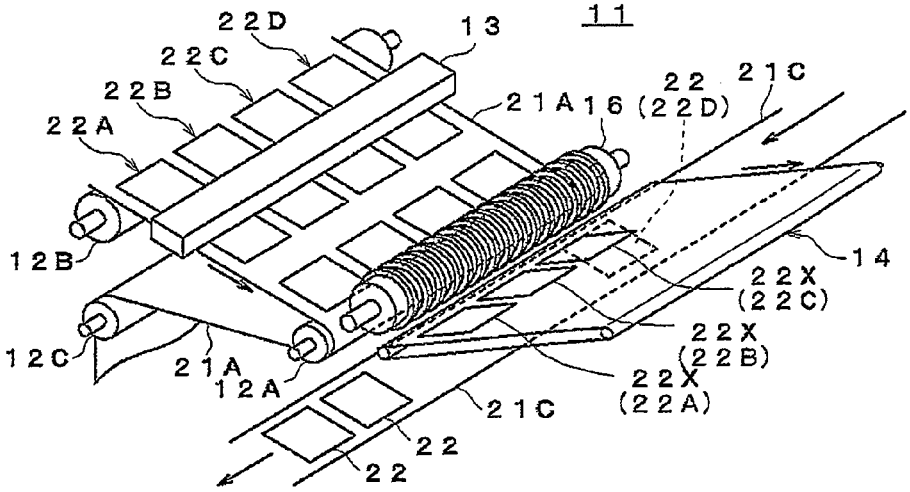
FIGS. 7A and 7B are explanatory views illustrating a further form of implementation of the label separating apparatus according to the present invention.
Figure 7B:
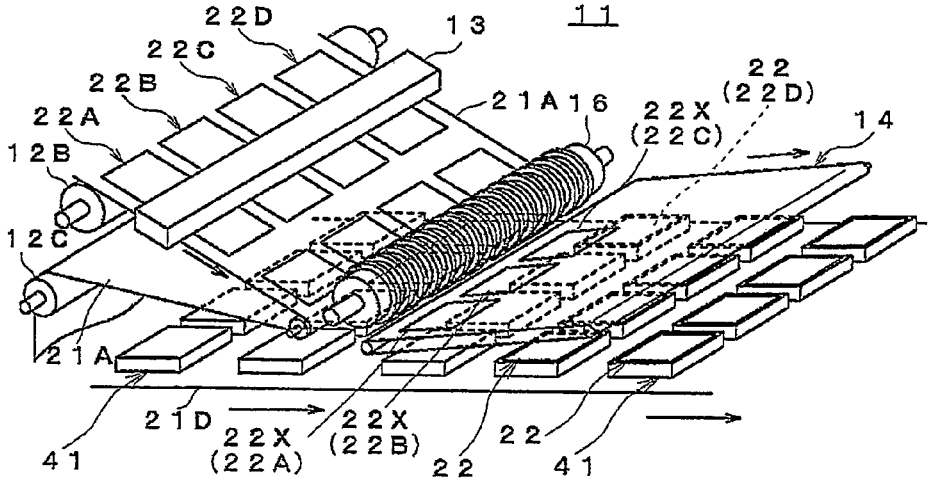

In FIGS. 7A and 7B there are diagrammatically shown further applicable forms of implementation of label separating apparatus according to the present invention. A label separating apparatus 11 shown in FIG. 7A substitutes the second continuous substrate 21B transported on the conveyer for good labels in the label separating apparatus 11 shown in FIGS. 1A to 1C with a third continuous substrate 21C transported with a transport mechanism (not shown) to cause good labels to be adhered thereto in a single row. Stated as in the previous forms of implementation, defective labels 22X (22A, 22B and 22C) are adhered to on the conveyer for defective labels 14 and an good label 22D is adhered onto the third continuous substrate 21C. If the third continuous substrate 21C is continuously transported, a position thereon corresponding to a defective label 22X is left vacant.

A label separating apparatus 11 shown in FIG. 7B substitutes the second continuous substrate 21B transported on the conveyer for good labels in the label separating apparatus 11 shown in FIGS. 1A to 1C, or substitutes the third continuous substrate 21C, with a fourth continuous substrate 21D (transported with a transport mechanism not shown) on which products 41 to be labeled are arranged to correspond to an arrangement of labels 22A to 22D on the first continuous substrate 21 to allow a good label to be adhered directly to a product 41. Stated as in the previous forms of implement, defective labels 22X (22A, 22B and 22C) are adhered to on the conveyer for defective labels 14 and good labels 22D are adhered onto products 41 at their corresponding positions on the fourth continuous substrate 21D. If the fourth continuous substrate 21D is continuously transported, a product 41 corresponding in position to a defective label 22X is left unlabeled.

What is claimed is:

1. A label separating apparatus for separating labels which are spaced apart from each other by a given distance and arranged in rows and columns on and peelably adhered to a first continuous substrate in transport, upon determining quality of labels, by transporting defective labels separately from a group of good labels, the apparatus comprising:

a primary conveyer for transporting said first continuous substrate having labels adhered thereto in rows and columns, said primary conveyer including a transport turn-back member for causing labels in each of the rows concurrently to peel off said first continuous substrate;

disposed in the vicinity of said transport turn-back member of the primary conveyer, a conveyer for defective labels for receiving defective labels selectively as adhered to thereon and transporting the defective labels thereby discriminatorily;

disposed in a region between said transport turn-back member of the primary conveyer and said conveyer for defective labels, a given number of air-blasting members each adapted to blast air to a label in each of the columns so that a label peeled off the continuous substrate and found defective is oriented in transport towards said conveyer for defective labels; and a label holding means for holding such a defective label oriented in transport by air from said air-blasting member to guide the defective label onto said conveyer for defective labels, said label holding means being formed with an air draining vent in a surface including its label holding area.

* * * * *